US007946014B2

(12) United States Patent
Tornero

(10) Patent No.: US 7,946,014 B2
(45) Date of Patent: May 24, 2011

(54) APPARATUS FOR ATTACHING WEBBING TO A FURNITURE FRAME

(75) Inventor: Roger Tornero, Greensboro, NC (US)

(73) Assignee: L & P Property Management Company, South Gate, CA (US)

( * ) Notice: Subject to any disclaimer, the term of this patent is extended or adjusted under 35 U.S.C. 154(b) by 1237 days.

(21) Appl. No.: 11/556,331

(22) Filed: Nov. 3, 2006

(65) Prior Publication Data

US 2008/0104816 A1 May 8, 2008

(51) Int. Cl.
*B25B 27/14* (2006.01)

(52) U.S. Cl. ..... 29/281.1; 29/564.8; 242/419.4; 242/420.2

(58) Field of Classification Search ..... 29/91.1, 29/281.1, 428, 564.8; 242/419.4, 419.8, 242/420.2, 422.5

See application file for complete search history.

(56) References Cited

U.S. PATENT DOCUMENTS 5,076,479 A * 12/1991 Davison ..... 224/324

* cited by examiner

*Primary Examiner* — Thiem Phan
(74) *Attorney, Agent, or Firm* — Shook, Hardy & Bacon L.L.P.

(57) ABSTRACT

This invention is directed to an apparatus for attaching webbing to a furniture frame. The apparatus includes a frame, a mounting assembly, and a webbing attachment assembly. The mounting assembly includes a clamping mechanism and a rack. The clamping mechanism is coupled to a lower portion of the frame while the rack is coupled to an intermediate portion of the frame. The clamping mechanism and rack are adapted to receive at least one furniture frame and hold the furniture frame in place. The webbing attachment assembly is coupled to the frame and is adapted to position the webbing relative to the at least one furniture frame to enable the webbing to be attached to the furniture frame.

8 Claims, 9 Drawing Sheets

APPARATUS FOR ATTACHING WEBBING TO A FURNITURE FRAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a method and apparatus for attaching webbing to a frame member, and more particularly to a method and apparatus for attaching webbing to a furniture frame member.

Webbing is typically attached to a furniture frame by hand. The webbing is typically attached to one side of the frame by staples. The user then stretches the webbing across the frame and staples it to the other side. This step is repeated for the desired number of pieces of webbing to be attached to the furniture frame. This process is very slow and time consuming. Further, the process does not provide consistent tension of the webbings across furniture frame member. Still further, the process also does not provide consistent spacing between the webbings without hand measurement.

Thus, there remains a need for an apparatus that enables a user to more efficiently attach webbing to a furniture frame member that provides constant spacing and tension of the webbing on the furniture frame member. Further, there remains a need for a method and apparatus that eliminates the need for the operator to continue to attach the webbing to the first rail by hand.

BRIEF SUMMARY OF THE INVENTION

Accordingly, the present invention provides a method and apparatus for attaching webbing to a furniture frame. The apparatus includes a frame, a mounting assembly, and a webbing attachment assembly. The frame includes a base, a front portion, and a rear portion. The front and rear portions of the frame are coupled together by the base, an upper connector bar, a connector plate, and a connector link.

The mounting assembly includes an adjustable rack and a clamping mechanism. The rack is mounted to the front portion of the frame at an intermediate position. The clamping mechanism is mounted to the front portion of the frame proximate a lower portion. The rack and clamping mechanism are used to provide support to the frame members when the apparatus is in use.

The webbing attachment assembly includes a guide roller, a counterbalance, and a tension mechanism. The guide roller is coupled to an upper portion of the front portion of the frame by a pair of arms. The counterbalance is also rotatably coupled to the pair of arms and extends therebetween. The tension mechanism includes a tension roller and an activation mechanism. The tension roller includes a gear and a plurality of slots that receive the webbings. The tension roller is coupled between the connector plates. The activation mechanism contains a lever, a drive cylinder, and a frame stabilizer. The lever is operationally coupled to the drive cylinder and the frame stabilizer such that when the lever is turned both the drive cylinder and frame stabilizer are activated. The drive cylinder includes a drive rack that mates with the gear on the tension roller and upon activation, causes the tension roller to rotate.

The operation of the apparatus will now be described. First, the webbing is placed within the slots on the tension roller. Next, the furniture frame member is loaded on the apparatus. The furniture frame member rests on the adjustable rack. Next, the webbing is stapled to a first side of the outer frame. The first frame is then lowered onto the clamping mechanism. Next, a second frame member is then placed on top of the first frame member and the rack and clamping mechanism are adjusted to fit the size of the frame members.

Once both frame members are loaded on the apparatus, the lever of the activation mechanism is turned and the frame stabilizers rotate forwardly to contact a portion of the furniture frame, thereby holding the furniture frames in place. The lever also activates the drive cylinder which causes tension roller to rotate. Rotation of the tension roller causes the webbings that are received in the slots to tighten. Once the webbings have been tightened, the user then staples the webbings to a second side of the outer frame of the first frame member and to a first side of the outer frame of the second furniture frame. After the webbings have been stapled, the user then cuts the webbings along a line. The cut allows the frame members to be separated from one another. The first frame member may then be removed and the second frame member fills the position of the first frame member. The process can then be used repeatedly for subsequent frame members. Additionally, this process can be performed as many times as needed by the user and provides an efficient and accurate way of attaching webbings to the frame members and eliminates the need for the user to continue to lead the webbing by hand for stapling.

Additional advantages and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
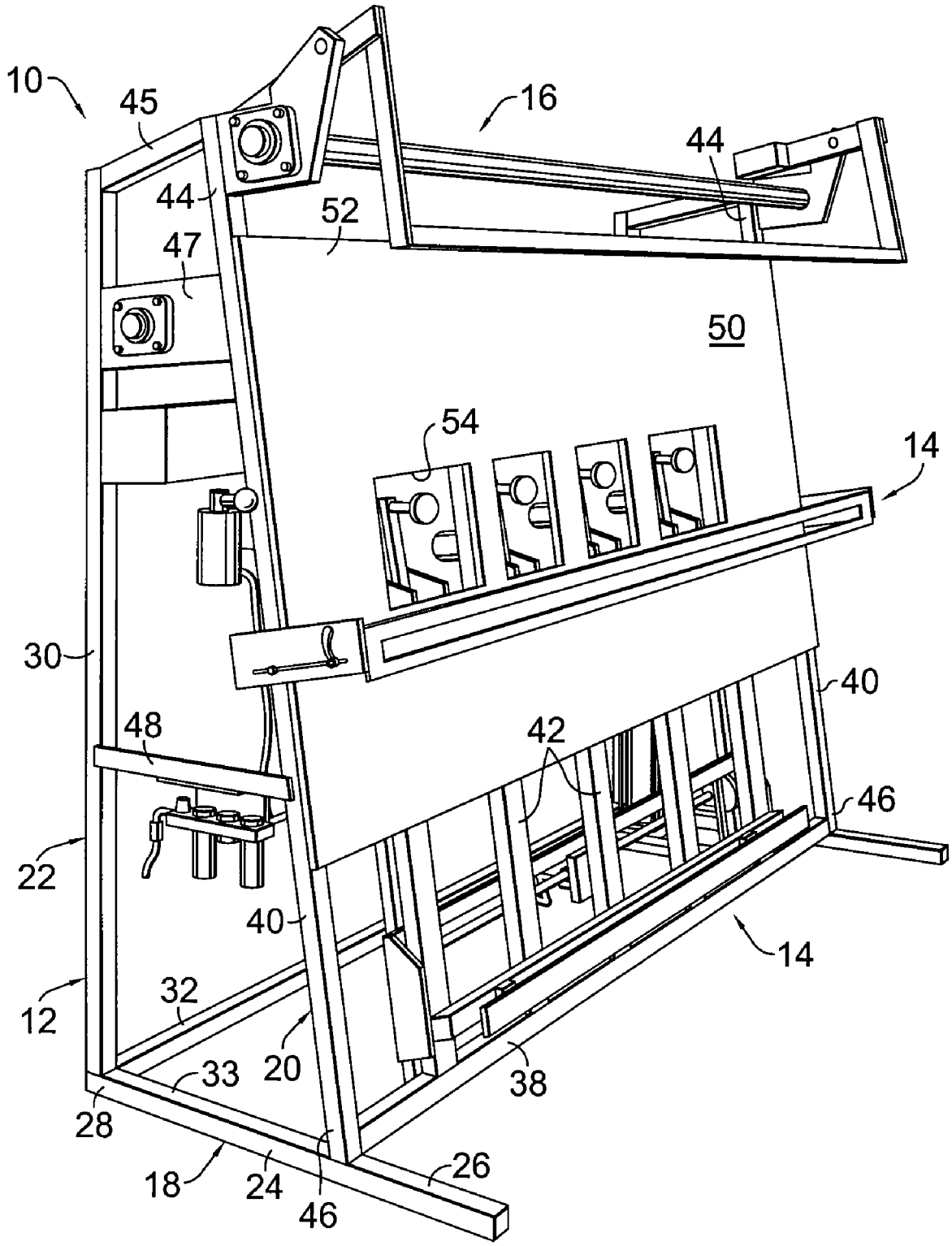
FIG. 1 is a front perspective view of an apparatus for attaching webbing to a furniture frame according to the present invention.

Referring to the drawings in greater detail and initially to FIG. 1, an apparatus for attaching webbing to a furniture frame is shown and designated generally by the numeral 10.

Figure 5:
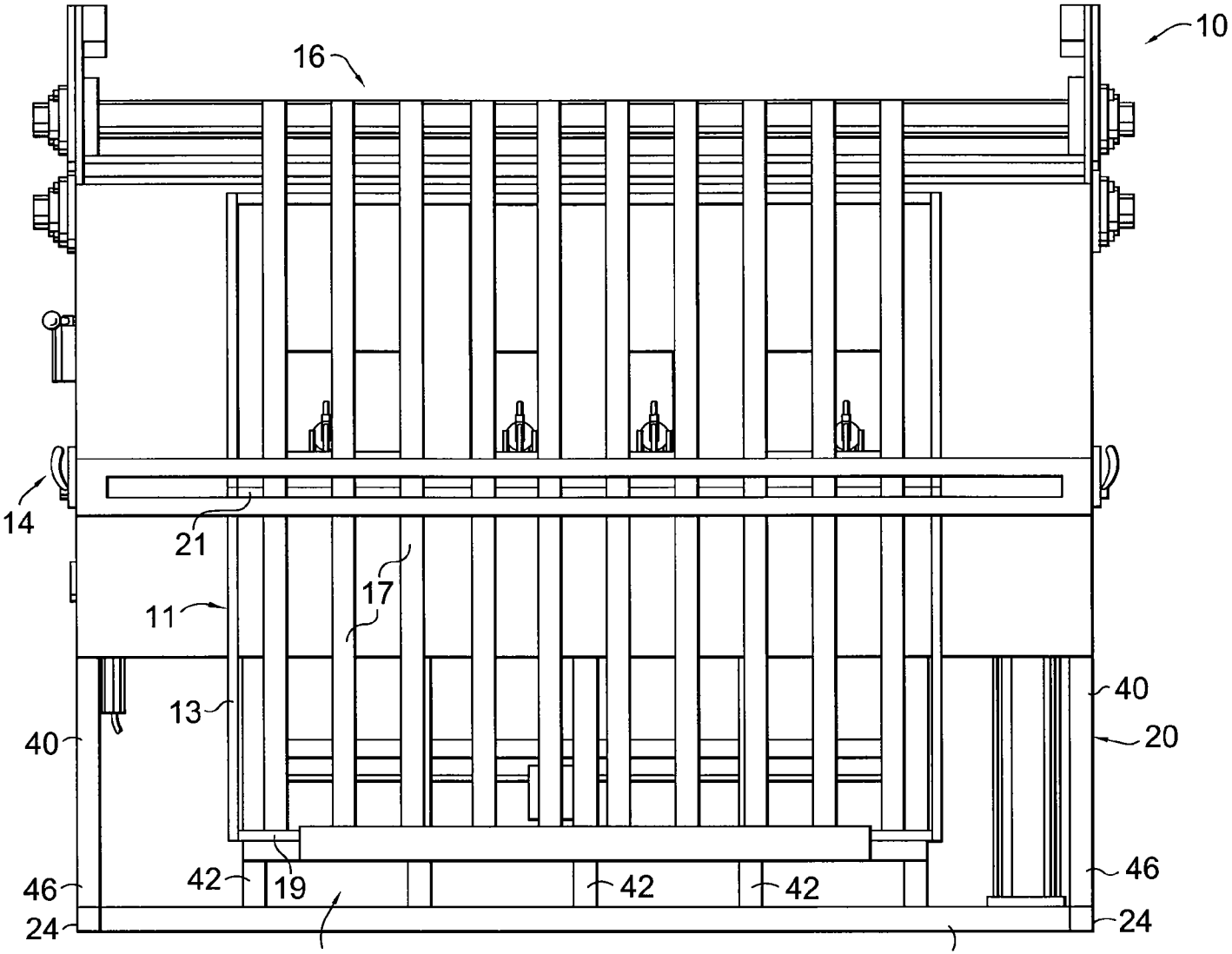
FIG. 5 is a front elevation view of the apparatus of FIG. 4.
Figure 6:
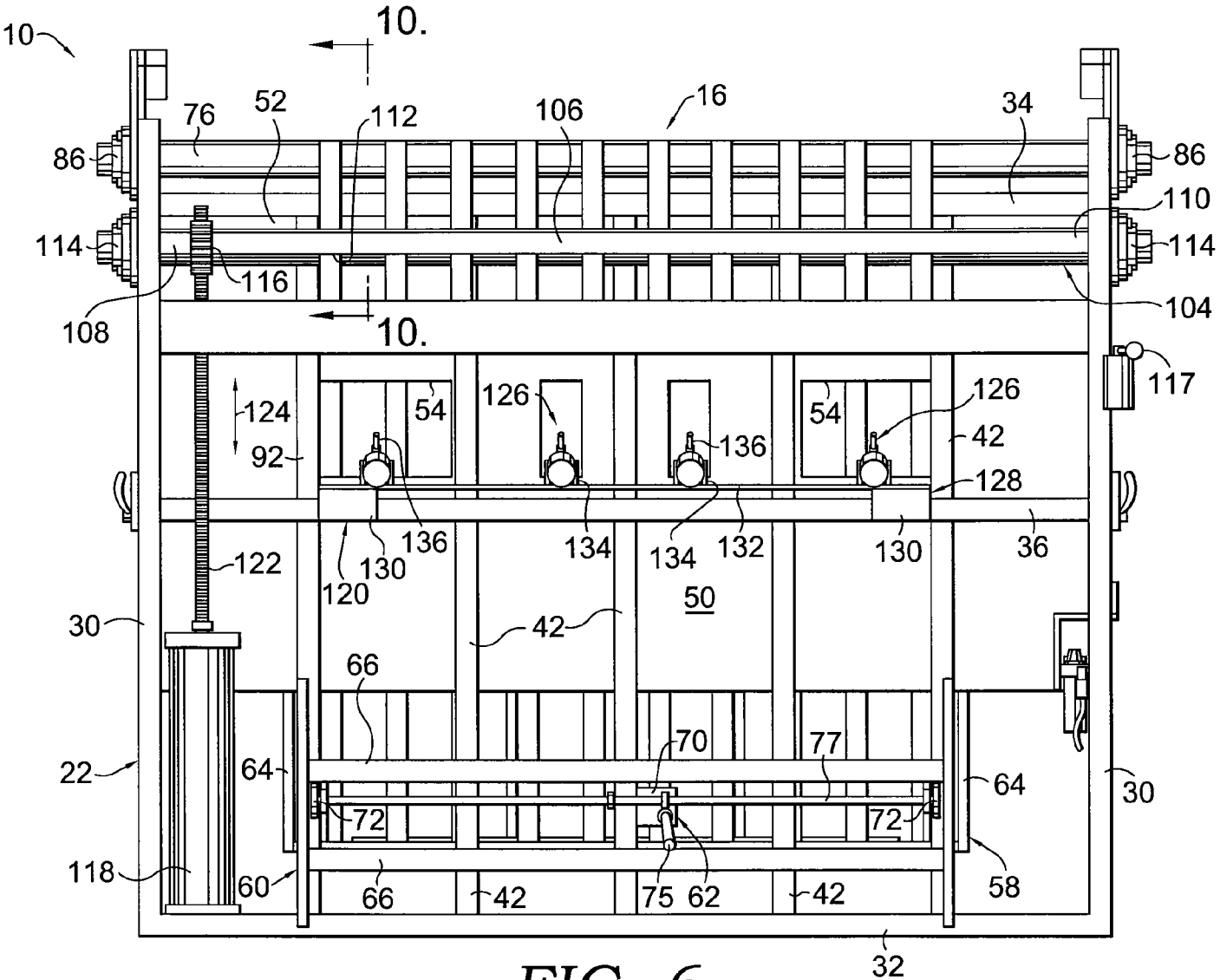
FIG. 6 is rear elevation view of the apparatus of FIG. 4.

Generally, as best seen in FIGS. 1, 5, and 6, the apparatus 10 broadly includes a frame 12, a mounting assembly 14, and a webbing attachment assembly 16. The frame 12 includes a base 18, a front portion 20, and a rear portion 22. The frame 12 is preferably made from steel bar with a generally rectangular cross-section; however, any suitable material and cross-section may be used. The base 18 include a pair of outer legs 24. The pair of outer legs 24 each have a front portion 26 and a rear portion 28. The legs 24 cooperate with cross bars 32 and 38 to provide support for the remainder of the frame 12.

Referring now to FIGS. 1 and 6, the rear portion 22 of the frame 12 will be discussed. The rear portion 22 of the frame 12 includes a pair of outer bars 30 and the cross bar 32. The outer bars 30 are coupled to the base 18 and extend upwardly therefrom. Specifically, the outer bars 30 are coupled to an upper surface 33 of the rear portion 28 of the outer legs 24 and extend generally upwardly and perpendicularly therefrom. The cross bar 32 is coupled to each leg 24 and extends therebetween. Coupling of the members of the frame occurs preferably via weldment, however it should be understood that any suitable coupling method may be used.

Referring now to FIGS. 1, 5, and 6, the front portion 20 of the frame 12 will be discussed. As best seen in FIG. 6, the front portion 20 of the frame 12 contains an upper 34 and a middle support bar 36. These supports 34 and 36 are obscured from view in FIGS. 1 and 5. As seen in FIG. 5, the front portion 20 also includes a lower cross bar 38, a pair of outer bars 40, and a series of inner bars 42. The outer bars 40 each have both upper and lower ends 44, 46. The upper cross bar 34 is coupled to the outer bars 40 proximate the upper end 44 while the lower cross bar 38 is coupled to the outer bars 40 at the lower end 46. The middle cross bar 36 is coupled to a rear surface of the inner and outer bars 42, 40 at a position intermediate the upper and lower cross bars 34, 38. Each of the plurality of inner bars 42 is located inwardly of the outer bars 40 and is coupled with the upper and lower cross bars 34, 38. The front portion 20 of the frame 12 is coupled to the rear portion 22 of the frame 12 by an upper connector bar 45, a connector plate 47, and a connector link 48.

The front portion 20 further contains a support plate 50. The support plate 50 is coupled to the outer and inner bars 40, 42 of the front portion 20. An upper portion 52 of the support plate 50 is mounted flush with the upper cross bar 34 and extends across the front portion 20 of the frame 12. The support plate 50 contains a plurality of apertures 54 located as shown. Frame 12 thus provides a sturdy, economical support for the mounting assembly 14 and the webbing attachment assembly 16.

Figure 7:
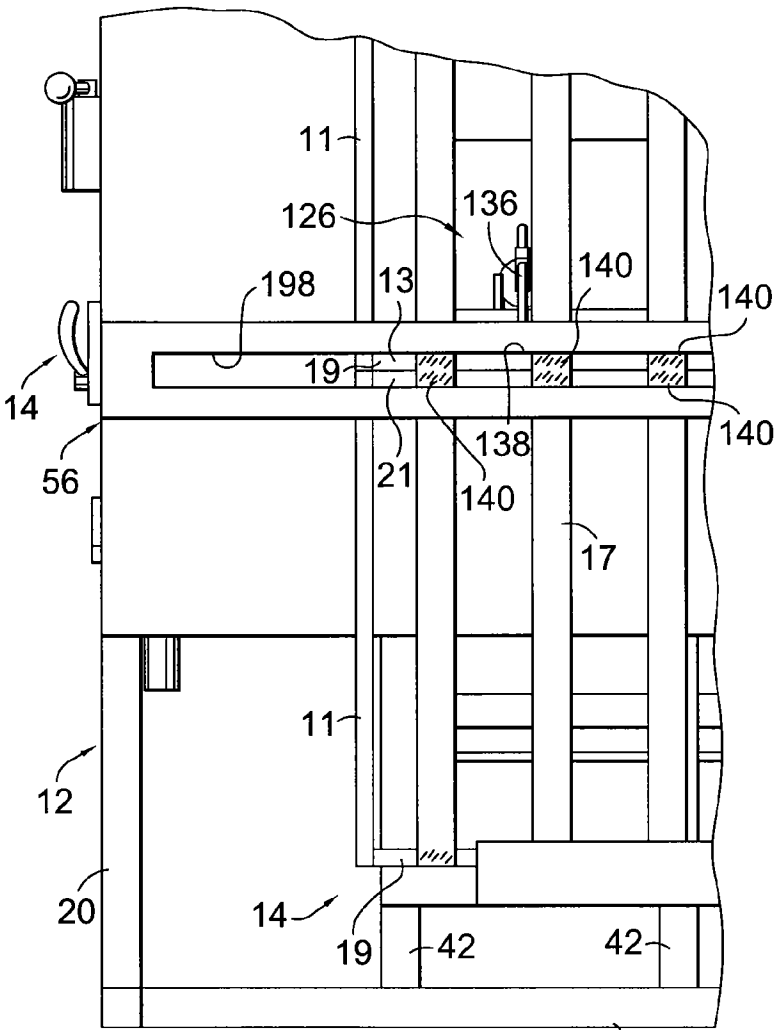
FIG. 7 is partial front view of the first and second frame members in the apparatus showing the webbing stapled to the frame members.
Figure 9:
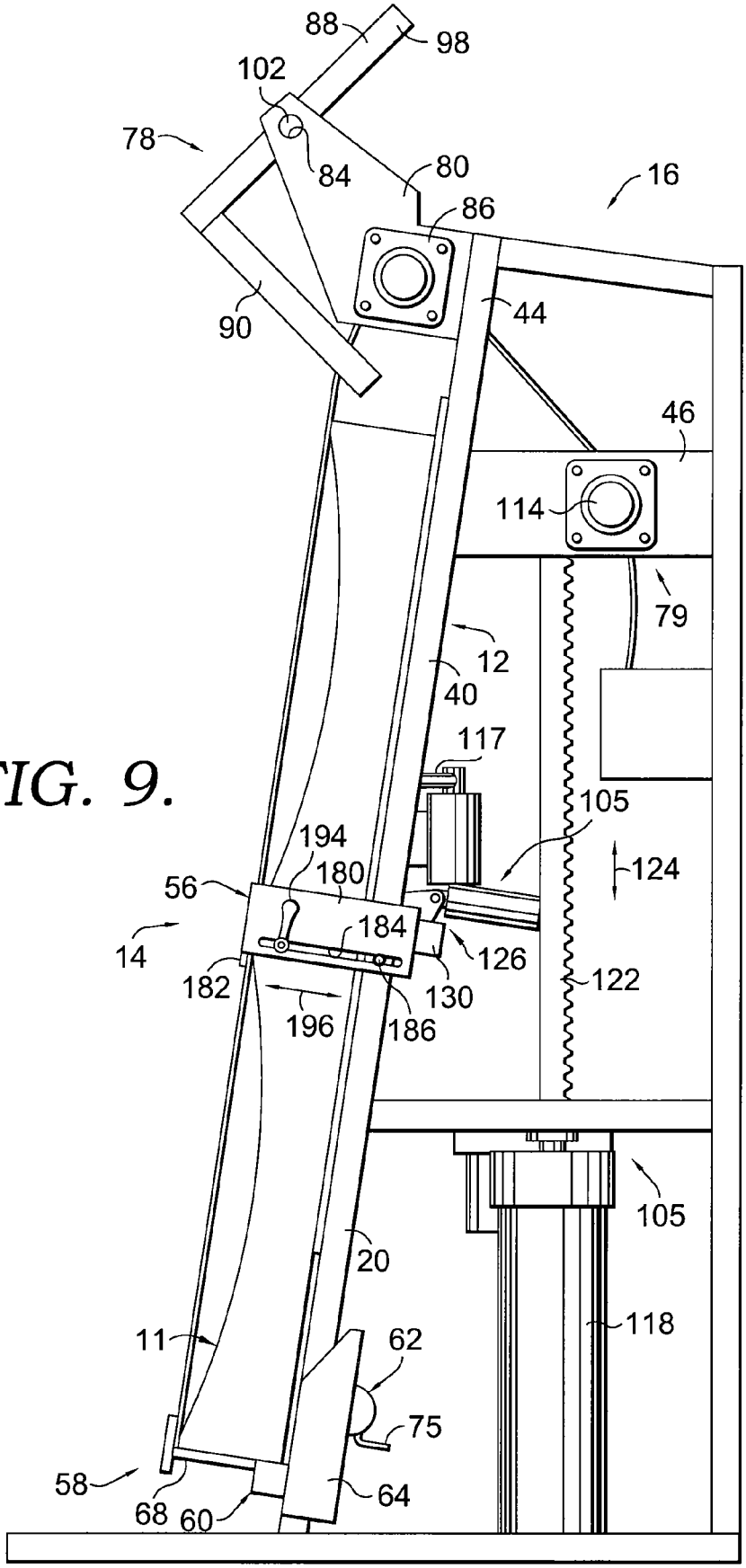
FIG. 9 is side elevation view of the apparatus of FIG. 4.

Referring now to FIGS. 6, 7, and 9, the mounting assembly 14 will be discussed. The mounting assembly 14 contains an adjustable rack 56 and a clamping mechanism 58. The clamping mechanism 58 is mounted horizontally to the plurality of inner bars 42 proximate the lower cross bar 38. The clamping mechanism 58 includes a mounting portion 60 and a clamping portion 62. The mounting portion 60 includes a pair of side plates 64, a pair of cross links 66, and a support rack 68. The clamping portion 62 includes a support 70, a pair of cams 72, and an adjustment mechanism having a lever 75 and a rod 77. The purpose of the clamping mechanism 58 is to hold the furniture frame during use. The adjustable nature of the clamping mechanism 58 allows different sizes of furniture frames to be used with the apparatus. As such, movement of the lever 75 by the user allows the support rack 68 to be adjusted such that the different sizes of furniture frames may be received within the clamping mechanism 58. Specifically, the rod 77 is received within the cams 72 such that rotation of the lever 75 turns the rod 77, which in turn, causes the cams 72 to rotate, thereby moving the support rack 68. It should be understood that any clamping mechanism may be used.

Figure 2:
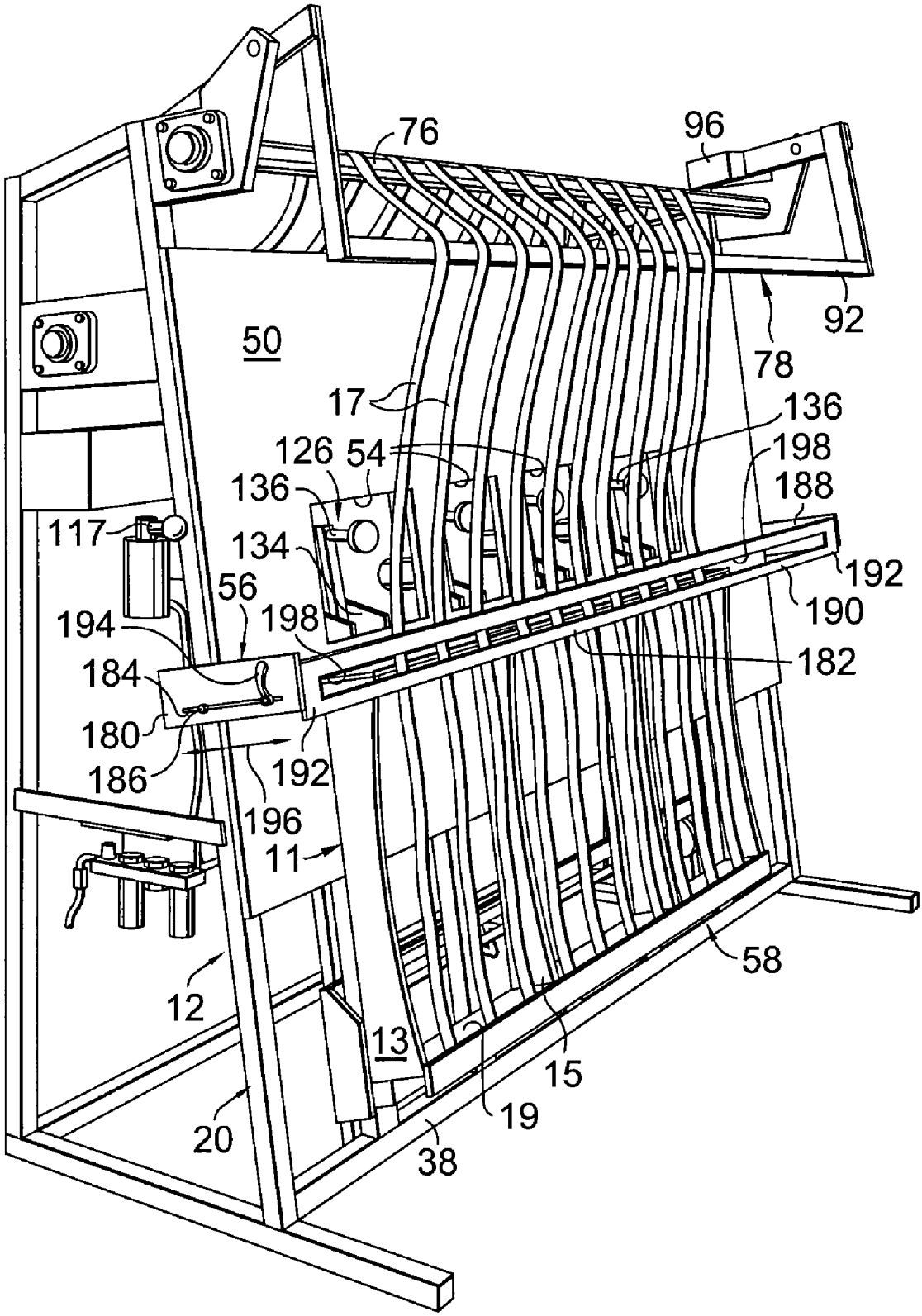
FIG. 2 is a view similar to FIG. 1, but showing a first frame member loaded on the apparatus, the webbing stapled to the first frame member, and the webbing in a loose position.
Figure 8:
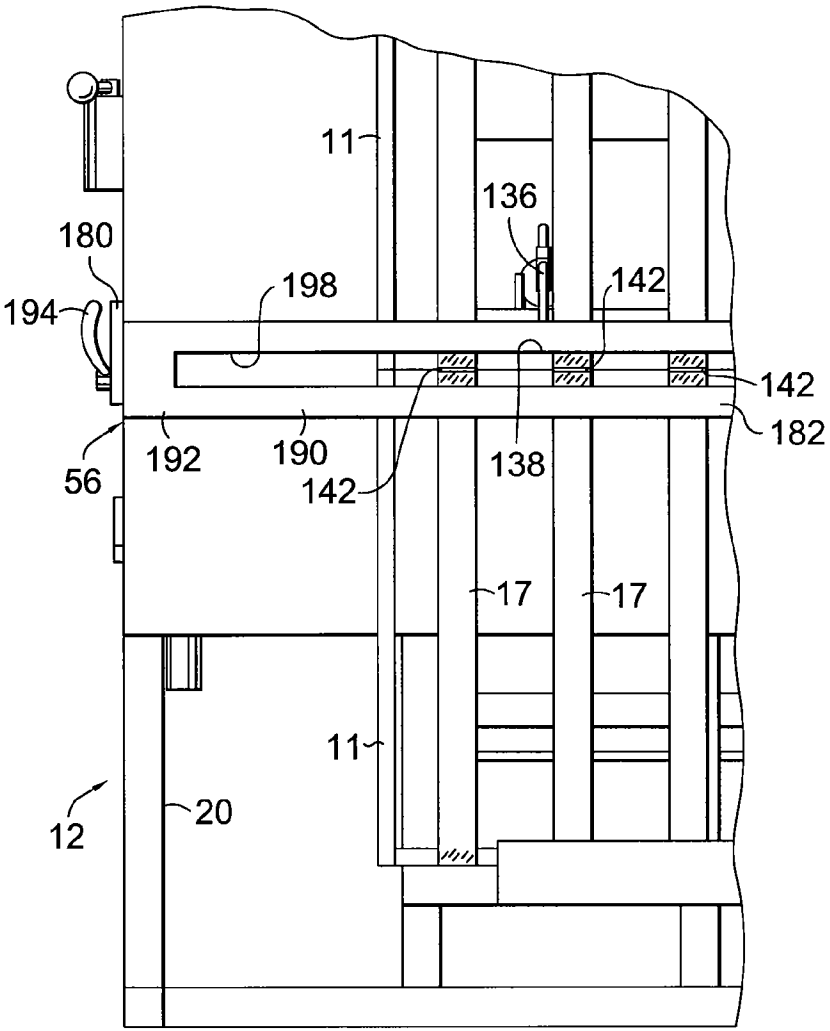
FIG. 8 is a view similar to FIG. 7, but showing the webbing cut.

Referring now to FIGS. 2, 8, and 9, the rack 56 will be discussed. The rack 56 is located at a position intermediate the upper and lower cross bars 34, 38 of the front portion 20 of the frame 12 and is coupled thereto. The rack 56 includes a pair of end plates 180 and a central member 182. The end plates 180 each contain an elongate slot 184 that allows for the attachment of the rack 56 to the frame 12 by a bolt connection 186. The central member 182 has a pair of sides 188 and a front member 190. The sides 188 each have an aperture, not shown, and are coupled to ends 192 of the front member 190 and extend generally perpendicularly therefrom. The elongate slot 184 further provides for attachment of the central member 182 to the end plates 180. Specifically a bolted clamp 194 extends through the elongate slot 184 of the end plates 180 and the apertures in the sides 188. As such, the elongate slots 184 along with the bolted clamp 194 allow the central member 182 to move with respect to the support plate 50 of the frame 12 as shown by arrow 196. The front member 190 includes a longitudinal channel 198, the purpose of which will be further discussed below. The front member further contains a pair of blocks, not shown, on a back side proximate the ends 192 of the front member 190.

Figure 10:
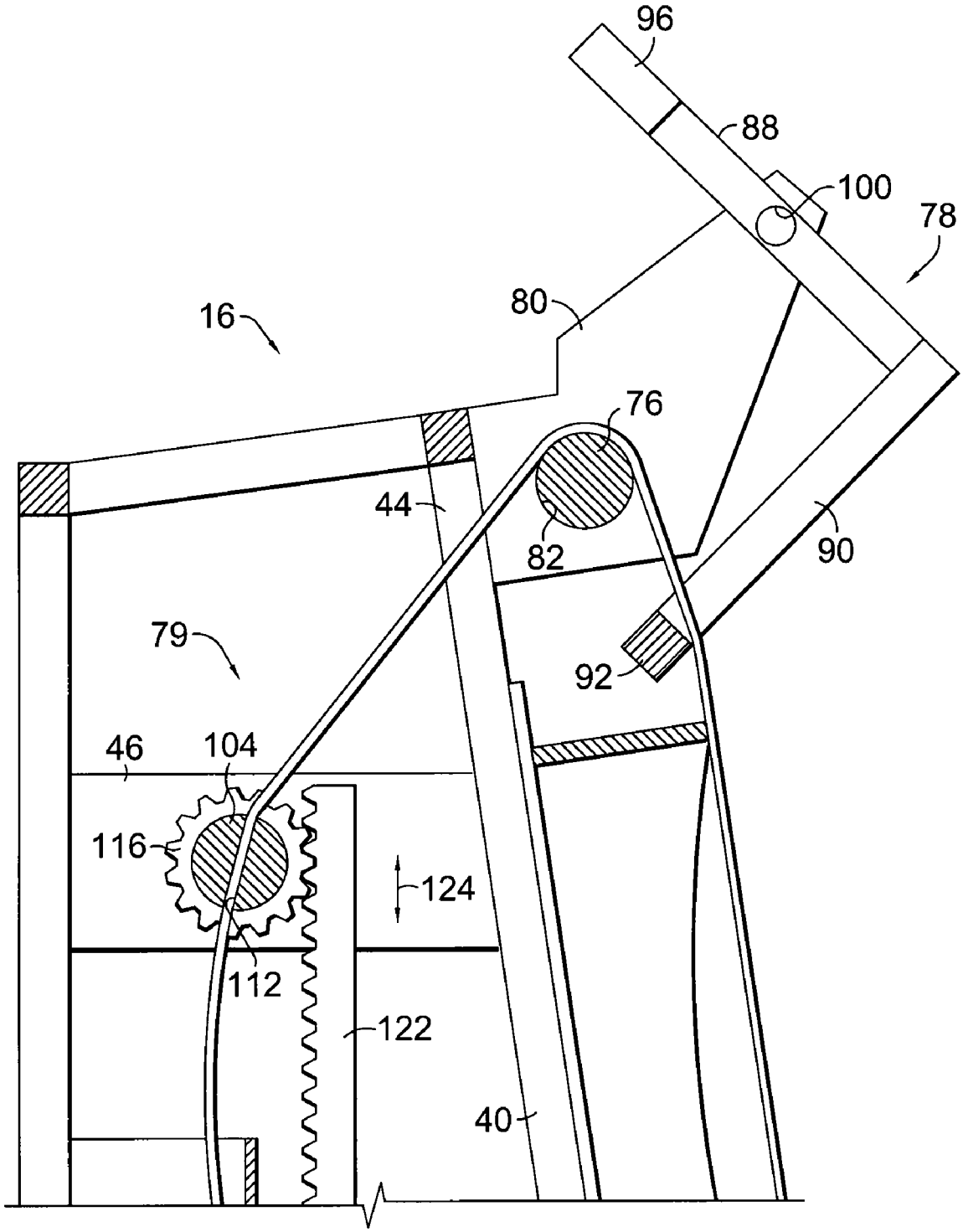
FIG. 10 is a partial cross-section view of the apparatus on FIG. 6, taken along the line 10-10.

Referring now to FIGS. 6, 9, and 10, the webbing attachment assembly 16 will be discussed. The webbing attachment assembly 16 includes a guide roller 76, a counterbalance 78, and a tension mechanism 79. The guide roller 76 is coupled to the upper ends 44 of the outer bars 40 of the front portion 20 of the frame 12 by a pair of arms 80. The arms 80 are shaped as shown and each contain a central aperture 82 and an upper aperture 84. The central apertures 82 each receive an end of the guide roller 76 and a pair of end caps 86 are placed over the ends of the guide rollers 76 to couple the guide rollers 76 to the arms 80. The upper apertures 84 attach the counterbalance 78.

Figure 3:
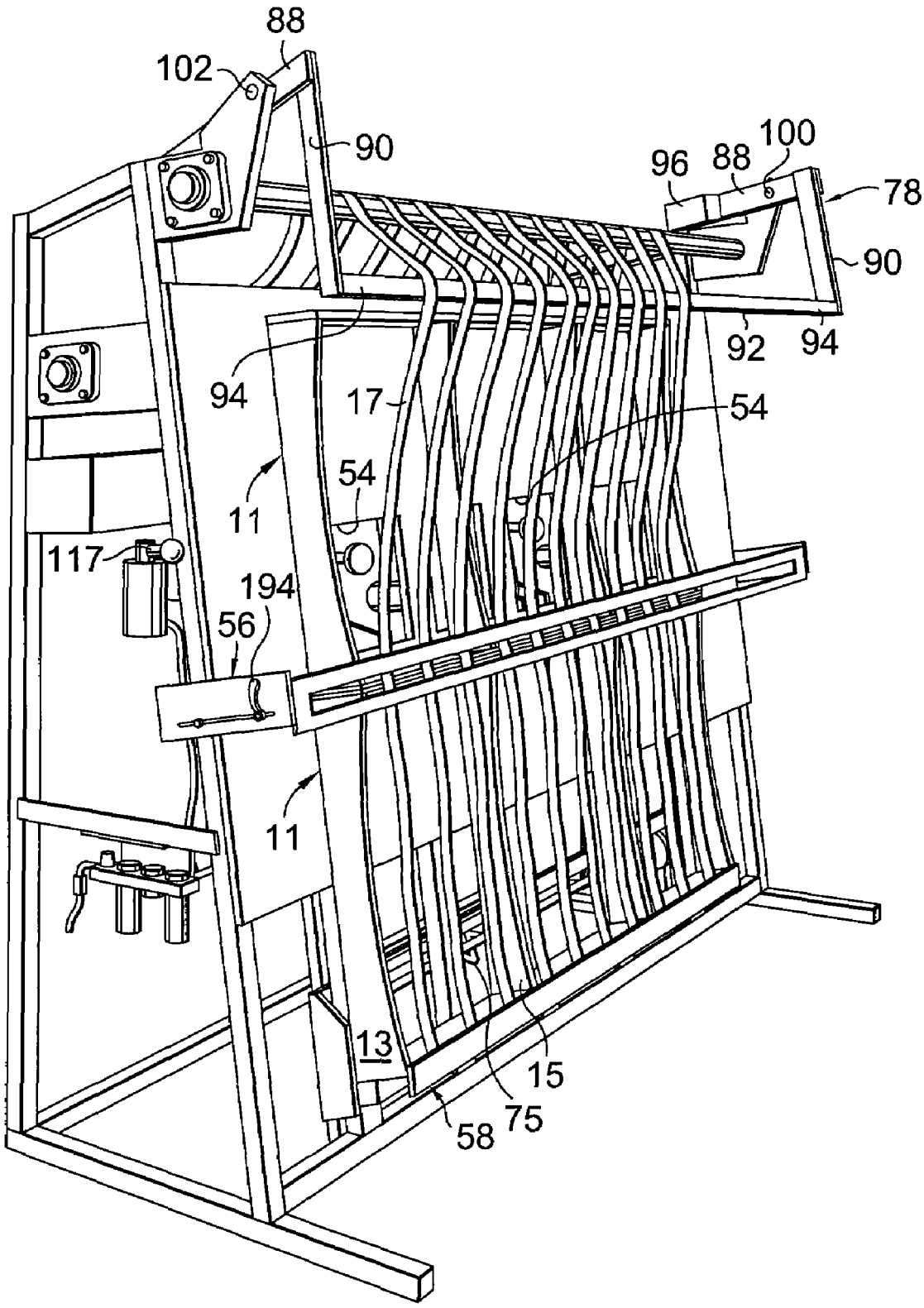
FIG. 3 is a view similar to FIG. 2, but showing a second frame member loaded on the apparatus.

Referring now to FIGS. 3, 9, and 10, the counterbalance 78 will be discussed. The counterbalance 78 contains a pair of lever arms 88, a pair of outer members 90, and a cross member 92. The cross member 92 is oriented generally horizontally and contains a pair of ends 94. The outer members 90 are coupled to the ends 94 of the cross member 92 and extend generally perpendicularly therefrom. The pair of lever arms 88 are coupled to the outer members 90 and extend rearwardly therefrom. The pair of lever arms 88 each hold a weight 96 attached at a rear portion 98, the purpose of which will be further described below. Each of the lever arms 88 of the counterbalance 78 further includes an aperture 100. The apertures 100 along with a connector 102 couple the lever arms 88 of the counterbalance 78 to the arms 80 located on the front portion 20 of the frame 12.

Referring now to FIGS. 6, 7, and 9, the tension mechanism 79 will be discussed. The tension mechanism 79 contains a tension roller 104, and an activation mechanism 105. The tension roller 104 contains a cylindrical tube 106 having a pair of ends 108, 110. The cylindrical tube 106 contains a plurality of slots 112 for receipt of the webbing material 17, as will be discussed further below. The tension roller 104 is coupled between the connector plates 46 by a pair of end caps 114. It should be understood that the connector plates each contain an aperture, not shown, that receives the ends 108, 110 of the tension roller 104. The tension roller 104 further contains a gear 116 at end 108, the purpose of which will be further described below.

The activation mechanism 105 contains a lever 117, and a drive cylinder 118, and a frame stabilizer 120. The drive cylinder 118 contains a drive rack 122 that is received therein and projects upwardly therefrom. It should be understood by one of ordinary skill in the art that the drive cylinder 118 is operationally coupled with the drive rack 122, such that, upon activation of the drive cylinder 118, the drive rack 122 moves upwardly and downwardly as show by reference numeral 124. The drive rack 122 mates with the gear 116 on the tension roller 104.

As seen in FIGS. 2, 6 and 8, the frame stabilizer 120 includes a plurality of stabilizing units 126 and a frame mount 128. The frame mount 128 includes a pair of brackets 130 and a support 132. The brackets 130 are spaced apart and mounted on the middle cross bar 36 of the front frame 12. The support 132 is a flat plate mounted on the brackets 130 and extends therebetween. Each of the stabilizing units 126 is mounted on the support 132. The stabilizing units 126 align with the apertures 54 on the support plate 50. The stabilizing units 126 each contain a mounting portion 134 and a hammer 136. The hammers 136 are rotatably coupled to the mounting portion 134. The frame stabilizer 120 is also operationally coupled with the lever 117.

The operation of the apparatus will now be described. The apparatus 10 is used to hold furniture frame members 11 to allow webbings 17 to be attached to the frame 11. The furniture frame members 11 include a generally rectangular outer frame 13 with a pair of inner frame members 15. The webbings 17 are typically attached to a first rail 19 of the outer frame 13 and extend across the outer frame 13 to a second rail 21 of the outer frame 13, as will be discussed further below.

FIG. 1 shows the apparatus 10 without the furniture frame members 11. First, the webbing is then placed within the slots 112 on the tension roller 104. Next, the furniture frame member 11 is loaded onto the apparatus 10. Initially, the furniture frame member 11 rests on the pair of blocks, not shown, on the back side of the front member 190 of the rack 56. Next, the webbing 17 is stapled to the first rail 19 of the outer frame 13. The furniture frame member 11 is then removed from the blocks and loaded onto the clamping mechanism 58, as shown in FIG. 2. As seen in FIG. 2 the webbing is draped over the counterbalance 78 and the guide roller 76. At this time the weights 96 on the counterbalance 78 cause the cross member 92 to push the loose webbing 17 away from the support plate 50. Next, as seen in FIG. 3, a second frame member 11 is placed on top of the first frame member 11. At this time the user may adjust the rack 56 and a clamping mechanism 58 to fit the size of the frame members 11. Adjustment of the rack 56 and clamping mechanism 58 is accomplished by bolted clamp 194 and lever 75. Specifically the rack 56 is adjustable with respect to the frame 12 by unbolting each bolted clamp 194, sliding the rack 56 to its appropriate position, and then clamping the bolted clamps. Further, the clamping mechanism 58 is adjustable with respect to the frame 12 by rotation of the lever 75 in either the clockwise or counterclockwise direction.

Figure 4:
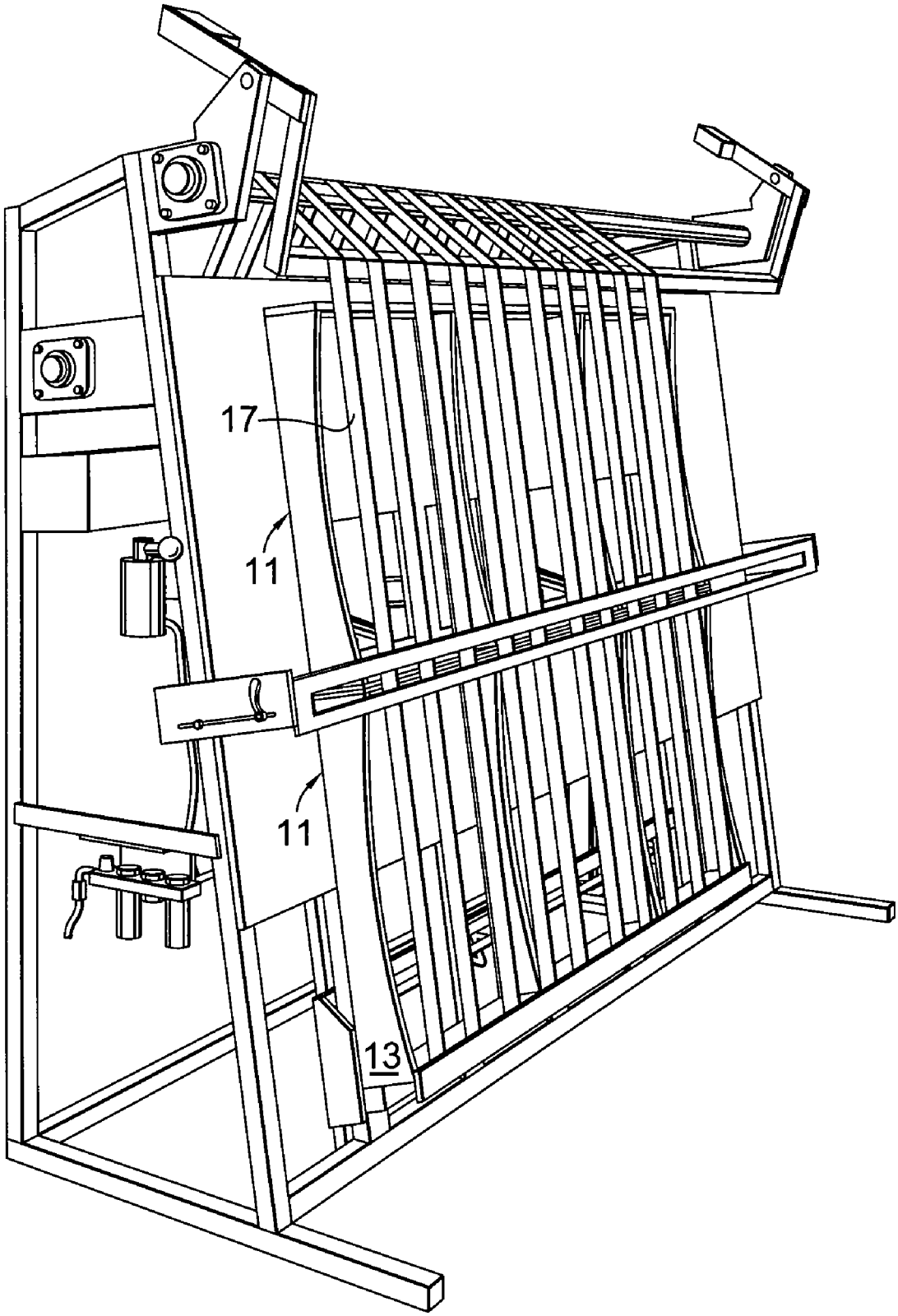
FIG. 4 is a view similar to FIG. 3 showing a second frame member loaded on the apparatus and the webbing in a tensioned position.

Once both frame members 11 are loaded on the apparatus, as shown in FIG. 3, the lever 117 of the activation mechanism 105 is turned. When the lever 117 is turned, the hammers 136 of the frame stabilizers rotate forwardly from the position of FIG. 3 to the position of FIG. 5-8 to contact a portion 138 of the furniture frame 11, thus holding both furniture frames 11 in place. The lever 117 also activates the drive cylinder 118 and causes the rack 122 to move upwardly, see FIGS. 6 & 9 and reference numeral 124. The upward movement of the rack 122 rotates the gear 116 causing the cylindrical tube 106 to rotate. Rotation of the cylindrical tube 106 causes the webbings 17 that are received in the slots 112 to tighten. Once the webbings 17 have been tightened, as seen in FIGS. 4 and 10, the user then staples the webbings 17 to the outer frame 13 as shown by reference numeral 140. The longitudinal channel 198 provides a guide to the user when stapling the webbings 17 to the outer frame. After the webbings 17 have been stapled, as shown in FIG. 7, the user then cuts the webbings 17 along line 142, as shown in FIG. 8. The cut allows the frame members 11 to be separated from one another.

Once the webbing 17 is cut, the user then turns the lever 116 to deactivate the activation mechanism 105. This returns the hammers 136 to their initial position of FIG. 6 and allows the tension roller 106 to move freely. At this time the weights 96 on the counterbalance 78 cause the cross member 92 to push the loose webbing 17 away from the support plate 50. The user may then remove the lower frame member 11 and the upper frame member 11 will slide into its place as the webbing 17 is already attached to the frame member 11. To begin the process again, the user would then add an additional new frame member 11 and begin again. This process can be performed as many times as needed by the user and provides an efficient and accurate way of attaching webbings 17 to the frame members 11.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An apparatus for attaching webbing to a furniture frame, the apparatus comprising:

a frame;

a mounting assembly including a clamping mechanism and a rack, the clamping mechanism being coupled to a lower portion of the frame, the rack being coupled to an intermediate portion of the frame, wherein the clamping mechanism and rack are adapted to receive at least one furniture frame and hold the furniture frame in place, and wherein the rack is a guide that aids attachment of the webbing to the at least one furniture frame and cutting the webbing; and a webbing attachment assembly coupled to the frame and adapted to position the webbing relative to the at least one furniture frame to enable the webbing to be attached to the furniture frame.

2. The apparatus of claim 1, wherein the webbing attachment assembly includes a guide roller and a tension mechanism, the guide roller being coupled to an upper portion of the frame and the tension mechanism being coupled to the frame at a position below the guide roller.

3. The apparatus of claim 2, wherein the tension mechanism includes a frame stabilizer that is coupled to an intermediate portion of the frame, wherein the frame stabilizer contacts the furniture frame when the tension mechanism is activated.

4. The apparatus of claim 3, wherein the tension mechanism includes a drive cylinder having a drive rack, the drive rack being coupled with a gear on the tension mechanism so that when the drive rack is moved by the drive cylinder the webbing is tensioned as the gear rotates.

5. The apparatus of claim 4, wherein the tension mechanism includes a plurality of slots that receive the webbing.

6. The apparatus of claim 5, wherein the webbing attachment assembly further includes a counter balance, the counter balance providing tension to the webbing.

7. The apparatus of claim 6, wherein the rack is adjustable with respect to the frame.

8. The apparatus of claim 7, wherein the clamping mechanism is adjustable with respect to the frame.

* * * * *